United States Patent [19]

Showman

[11] Patent Number: 4,655,185

[45] Date of Patent: Apr. 7, 1987

[54] PRESSURE REGULATING DEVICE

[76] Inventor: Gerald Showman, 440 E. Georgia Ave., Connellsville, Pa. 15425

[21] Appl. No.: 762,508

[22] Filed: Aug. 5, 1985

Related U.S. Application Data

[62] Division of Ser. No. 691,979, Jan. 17, 1985, Pat. No. 4,553,512.

[51] Int. Cl.[4] ..... F02M 41/00

[52] U.S. Cl. ..... 123/459; 137/543.19; 123/196 S

[58] Field of Search ..... 137/540, 543.19; 123/459, 196 S; D23/21

[56] References Cited

U.S. PATENT DOCUMENTS

| | | | |
|---|---|---|---|
| 115,780 | 7/1939 | Carnes | D13/21 |
| D. 203,920 | 2/1966 | Balsamo | D23/21 |
| D. 233,082 | 10/1974 | Tayleur | D23/21 |
| 2,178,756 | 11/1939 | Joost | 123/196 |
| 2,318,721 | 5/1943 | Siver | D23/21 |
| 2,356,970 | 8/1944 | Brockett | D23/21 |
| 2,413,069 | 12/1946 | Reagan | 123/196 |
| 2,838,039 | 6/1958 | Smith et al. | 123/196 |
| 2,867,203 | 6/1959 | Easton et al. | 123/196 |
| 2,879,754 | 3/1959 | Von Kienlin et al. | 123/140 |
| 3,058,486 | 10/1962 | McDermott et al. | 137/543.19 |
| 3,425,404 | 2/1969 | Lamkin | 123/196 |
| 3,503,418 | 3/1970 | Petrucci et al. | 137/543.19 |
| 3,583,525 | 12/1968 | Holcomb | 184/6 |
| 3,601,154 | 8/1971 | Demler, Jr. | 137/543.19 |
| 3,816,040 | 6/1974 | Janik | 127/179 F |
| 3,917,027 | 11/1975 | Hakanson et al. | 123/179 F |
| 3,970,063 | 7/1976 | Mayr et al. | 123/459 |
| 4,061,204 | 12/1977 | Kautz | 184/6.3 |
| 4,094,293 | 6/1978 | Evans | 123/196 S |
| 4,112,910 | 9/1978 | Percy | 123/196 |
| 4,168,693 | 9/1979 | Harrison | 123/196 S |
| 4,199,950 | 4/1980 | Hakanson et al. | 123/179 F |
| 4,432,386 | 2/1984 | Pacht | 137/543.19 |
| 4,543,935 | 10/1985 | Tuckey | 123/459 |

OTHER PUBLICATIONS

Enclosed photograph believed to be a pump of the general class of the present invention.

*Primary Examiner*—E. Rollins Cross
*Attorney, Agent, or Firm*—Arnold B. Silverman

[57] ABSTRACT

A pump assembly which operates in connection with a starter motor is provided. The device, which is of small dimensions is contained with a compact pump housing. A gear pump is provided within the pump housing which is operatively associated with the drive shaft of a starter motor. A shaft extension device is also provided which may be adapted to a starter motor drive shaft thereby allowing the device of the present invention to be used with a variety of starter motors. The pump assembly is provided with a fluid delivery system which is operatively associated with the fluid inlet means in the pump housing. Further provided is a receiver means which receives fluid discharged from the outlet means of the pump housing. A pressure regulating device may also be provided within the end cap of the pump housing. The pressure regulating device is operatively associated with the pump assembly and controls fluid pressure in the pump fluid cavity during operation of the pump assembly.

4 Claims, 13 Drawing Figures

PRESSURE REGULATING DEVICE

This is a divisional of 691,979 filed on Jan. 17, 1985, now U.S. Pat. No. 4,553,512, for Fluid Pump Assembly.

BACKGROUND OF THE INVENTION

1. Field of the Invention

This invention relates to a fluid pump assembly which operates in connection with a starter motor. The device can be employed in a variety of ways in connection with a vehicle.

2. Description of the Prior Art

Internal combustion engines are generally provided with a lubrication system for the engine which includes an oil pump operated from the engine whereby necessary lubricant is continuously delivered to the various working parts and bearing surfaces of the engine. In general, an interval of time is required just after starting an engine to fully lubricate the bearing surfaces of the engine. It has been found that, when an engine has remained inoperative for some time, the lubricant drains from the bearing surfaces and a subsequent startup results in engine operation prior to sufficient lubrication. It has been found that significant engine wear occurs due to engine operation prior to sufficient lubrication of the bearing surfaces.

Various types of devices have been designed in an attempt to solve this problem of engine wear by temporarily providing initial lubrication systems which may be positioned within a housing attached to the starter motor. Those initial lubrication systems operate until the normal lubrication system becomes sufficiently pressurized so that it provides lubrication to the engine. Many of these systems, however, have created other problems. Specifically, the auxiliary oil systems are quite large and have been known to require a large amount of space under the hood in which the engine is housed. Secondly, the prior art devices are expensive to manufacture and in some instances are not adaptable to a variety of engine types. See, for example, U.S. Pat. Nos. 2,413,069, 2,867,203, 4,061,204 and 4,094,293.

There remains a need for an improved device which requires a minimal amount of space under the hood and which is economical to manufacture and use. There also remains a need for such a device which is adapted to be fitted to various types of internal combustion engines and further adapted for use with fluids other than lubricants.

SUMMARY OF THE INVENTION

The present invention has produced a solution to the above-described need by providing a device which operates in connection with the starter motor of an engine. Specifically, there is provided a pump described in greater detail hereinafter which is adaptable to one end of a starter motor. Further provided is a device of small dimensions which is contained within a compact generally circular housing.

This device increases engine life by effectively prelubricating the working parts of an engine.

An object of the present invention is to provide a pre-lubricating device which effectively lubricates an engine, but which requires only a small amount of space under the hood.

It is a further object of the invention to minimize engine wear and thereby to increase engine life.

It is yet a further object of the invention to provide a pump which is easily adaptable to various types of engine starter motors and which would require only a minimum amount of modification for retrofitting.

It is a further object of the invention to provide a device, one embodiment of which, is particularly suitable for use with diesel engines.

It is yet a further object of the invention to provide a pump which can be used to transport fluids other than lubricants.

These and other objects of the invention will be fully understood from the following description of the invention with reference to the illustrations appended hereto.

DESCRIPTION OF THE PREFERRED EMBODIMENTS

The present invention provides a device for employing a vehicle starter motor to provide a pumping action to a fluid. For example, the device may be used as an auxiliary oil pump which is adapted to supply oil to an engine prior to operation of the starter motor. In addition, the device can be used to pump hydraulic fluid necessary or desired in other working parts of the vehicle. With respect to engine lubrication, the device involves a gear-type pump encased in a generally circular hollow housing of small dimensions. Specifically, the maximum transverse dimension of the base portion of the device would be about 2 to 8 inches and is preferably about 3 to 6 inches, and the height of the device is about $1\frac{1}{2}$ to 5 inches and is preferably about 2 to 4 inches. The pumps may be sized according to starter diameter. The device is adapted to supply oil to an engine prior to operation of the engine. The device is an improved auxiliary pump which would engage one end of a starter motor and would require a minimal amount of space under the hood of the vehicle.

In general, the gear pump begins to operate when the ignition switch is closed activating a first solenoid and the shaft of the starter motor begins to turn. This rotating starter motor shaft is adapted to drive one gear of the pump. In one embodiment of the device the pump would thereby introduce oil into the engine. When the engine reaches full pressure, a pressure switch functions to operate a second solenoid which operates the starter motor which in turn, starts the engine. Thus, the engine is fully lubricated prior to operation.

The gear-type mechanism of this device has a large output considering that it may be driven by a 3 hp motor. Moreover, this device is economical to manufacture. In addition, the inlet and outlet ports of the pump have alternative ports disposed generally perpendicular to one another for ease of access. One of the alternative ports may be selected and a conduit constructed of flexible hydraulic hose may be attached thereto; the others may be plugged. Thus, a variety of fittings for inlet and outlet conduits to accommodate varying locations of fluid reservoirs and receiver parts are provided.

Figure 1:
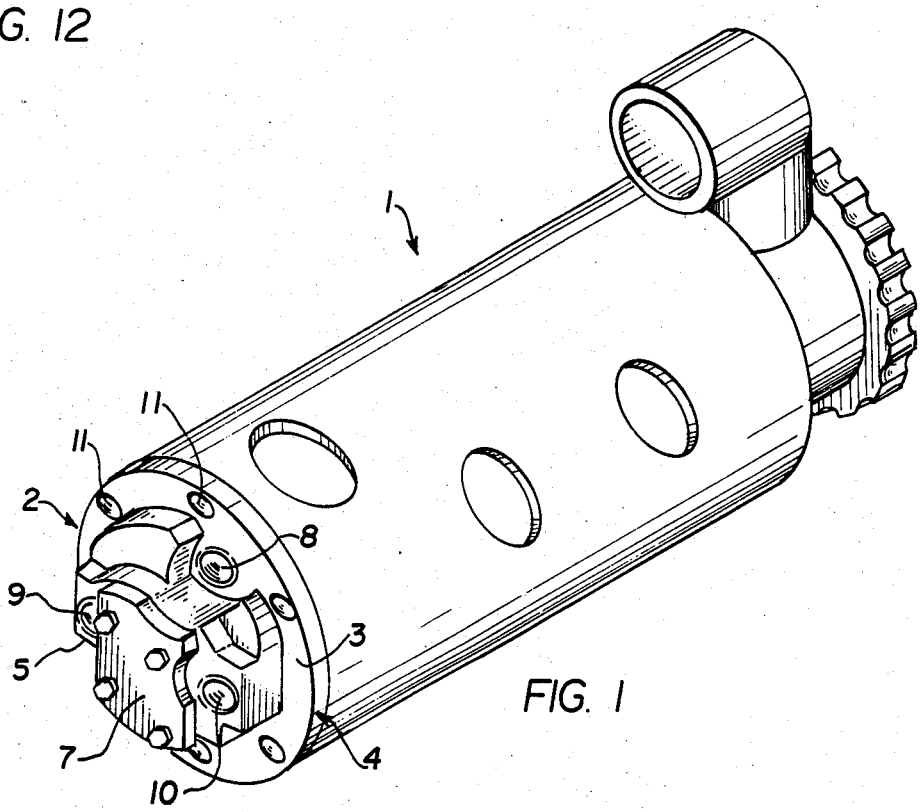
FIG. 1 is a perspective view of a preferred embodiment of the device as connected to a starter motor.
Figure 2:
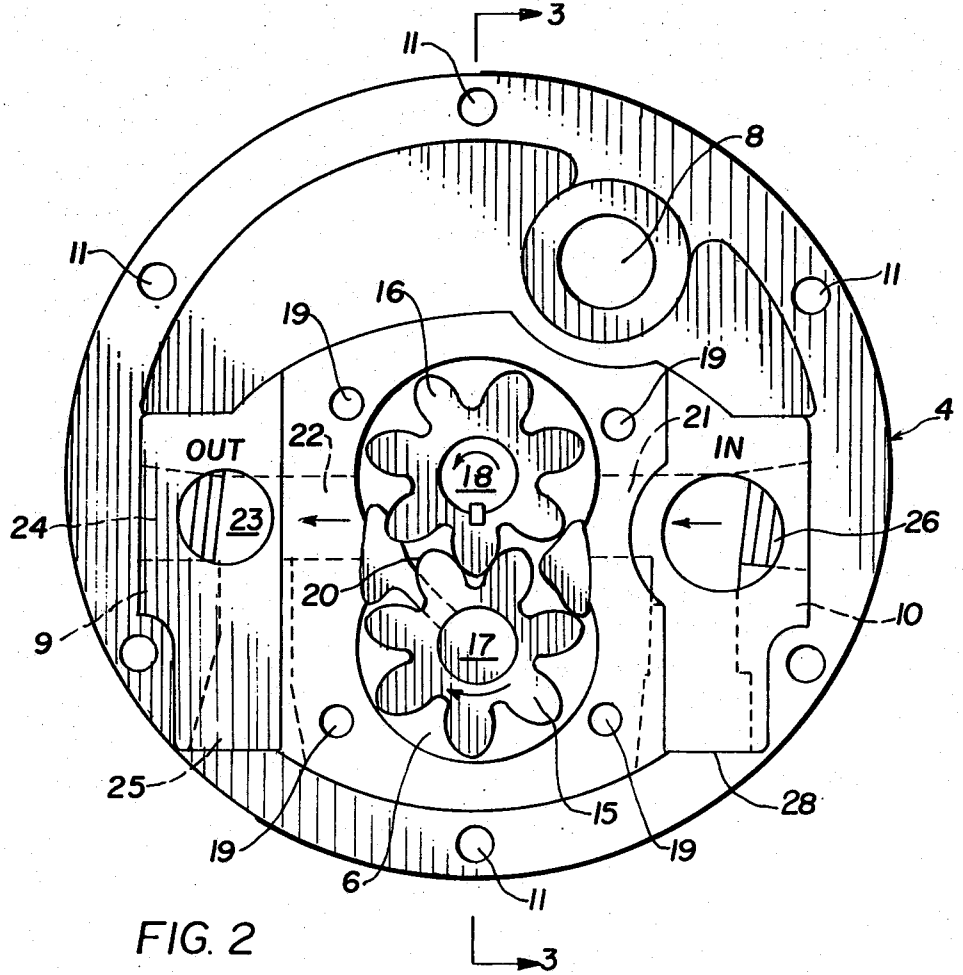
FIG. 2 is a top plan view of a preferred embodiment of the device.

Referring to FIGS. 1 and 2 the device is shown as connected to a starter motor indicated generally at 1. The device of the present invention is indicated generally at numeral 2. The device includes generally circular housing 3 having outer annular flange 4 and chamber 5. The pump housing is preferably constructed of aluminum, cast iron, plastic, or other suitable materials. The chamber 5 houses fluid cavity 6. End cap 7 is secured to chamber 5 and covers fluid cavity 6. Fluid outlet means 9 and fluid inlet means 10 are shown. Aperture 8 in outer flange 4 receives a ground lug (not shown) from the starter motor.

Circular housing 3 is secured to the starter motor 1 by suitable screws or bolts or other securing means (not shown) received through registered holes 11 formed in outer flange 4.

Referring to FIG. 2, circular flange 4 has holes 11. Fluid cavity 6 contains gear means 20 which comprises meshed driven gear 16 and idler gear 15 which are mounted, respectively, on shafts 18 and 17. Interior passageway 21 extends from one wall of fluid cavity 6 through chamber 5 to fluid inlet means 10. Opposing passageway 22 extends from the opposing wall in fluid cavity 6 through chamber 5 to fluid outlet means 9. Fluid inlet means indicated at 10 has alternative ports 28 and 27 also shown in FIGS. 5, 6 and 7. Ports 28 and 27 are generally perpendicular to one another, one being vertical and the other horizontal in the orientation shown in FIG. 7.

One of these alternative passageways can be plugged; the second receives a conduit carrying the fluid from the fluid delivery system of the present invention to the pump assembly.

Figure 5:
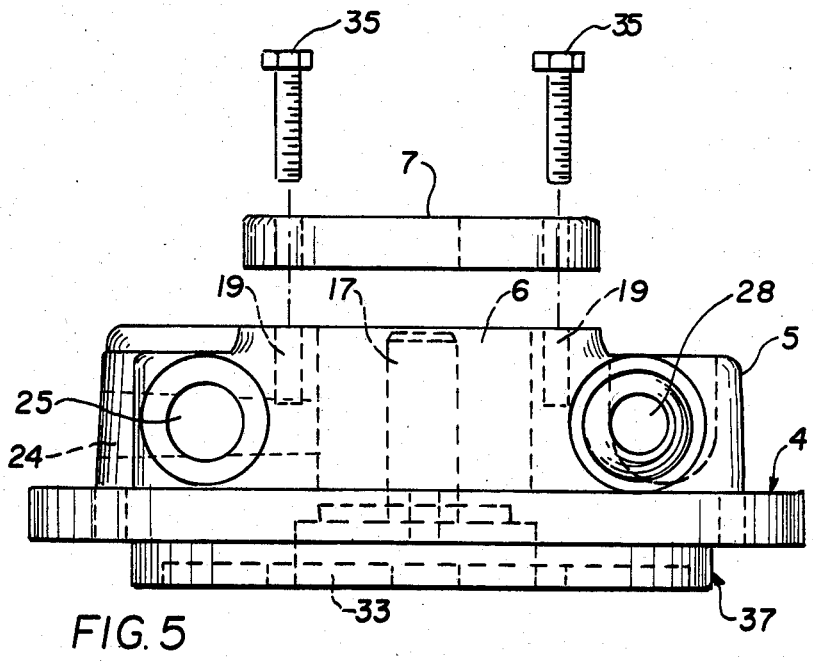
FIG. 5 is an exploded view of a side elevation of a preferred embodiment of the device with the end cap shown as displaced from the housing of the device.

Fluid outlet means indicated at 9 has alternative ports 23, 24 and 25 also shown in FIGS. 2 and 5.

Figure 6:
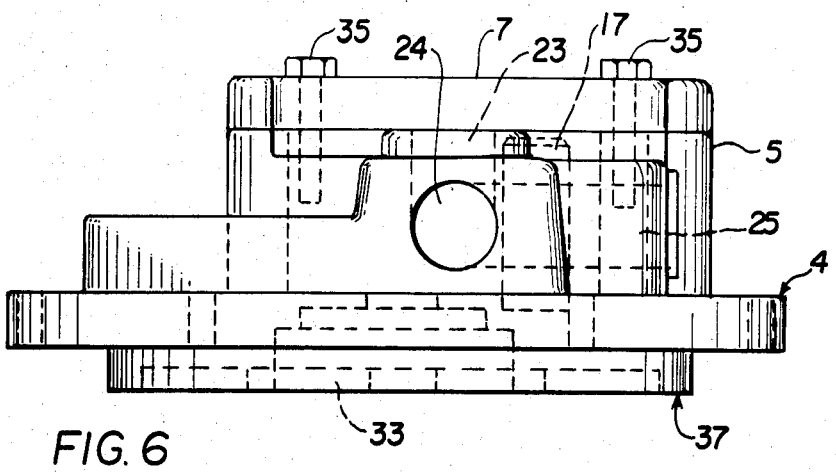
FIG. 6 is a left side elevation of a preferred embodiment of the device.
Figure 7:
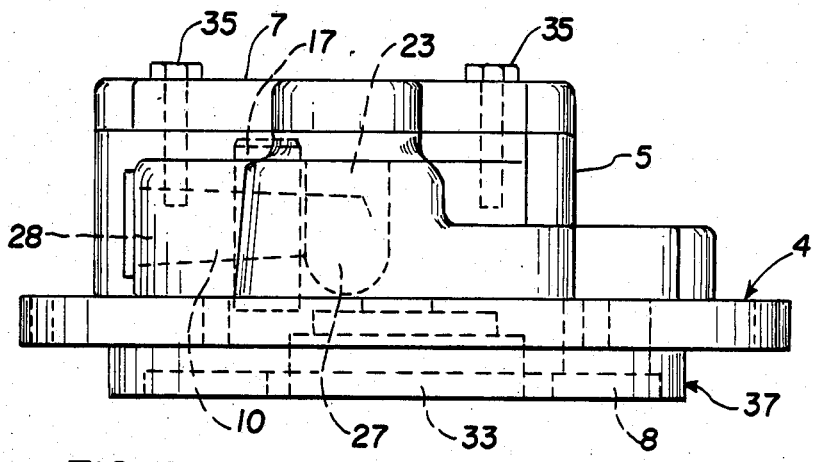
FIG. 7 is a right side elevation of a preferred embodiment of the device.

Port 24 is generally perpendicular to port 23, and port 25 is generally perpendicular, but lies in the same plane as port 24. Port 25 is also perpendicular to port 23. Port 24 is shown in FIG. 6. Port 25 is shown in phantom in FIG. 6. These alternative ports are tapped so that matching threads in the conduits may be engaged therein.

Holes 19 are for receiving bolts or other suitable securing means for securing end cap 7 to the chamber 5 to cover fluid cavity 6. (FIG. 2).

Figure 3:
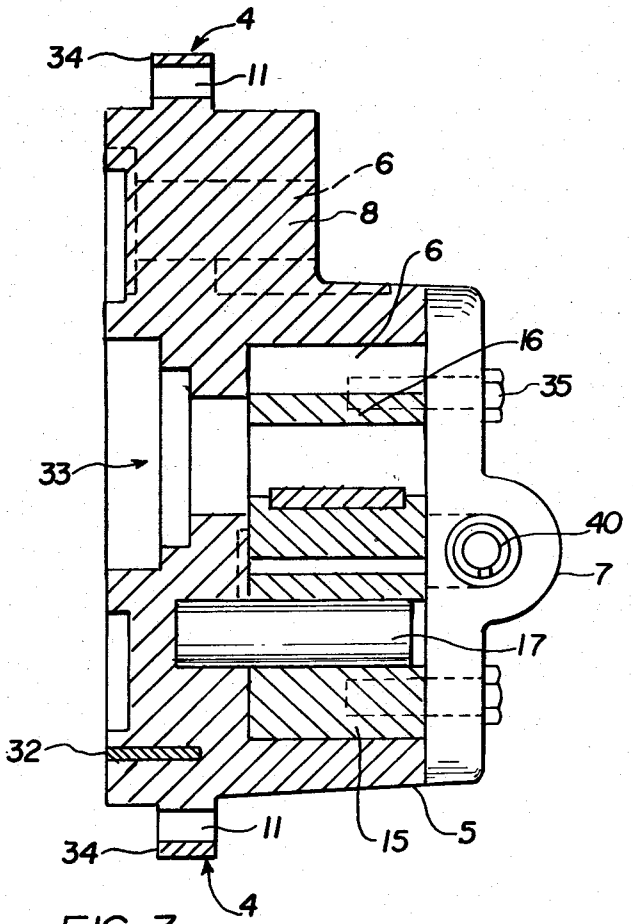
FIG. 3 is a cross-sectional view taken along lines 3—3 of FIG. 2.

As shown in FIG. 3, end cap 7 houses pressure regulator 40 and is secured to chamber 5 by means of bolts 35. Gears 15 and 16 are shown in section. Gear 16 is driven by the shaft extension means (not shown), and gear 15 is driven by gear 16. When the device of the present invention is secured to the starter motor 1, the sealing surface to the device which includes rim 37 and bore 33 engages the starter. The bore 33 receives the starter motor drive shaft (not shown) or the drive shaft extension means of the present invention which will be more particularly described hereinafter. Bore 33 also has seal means provided therein to create a seal around the shaft.

Figure 4:
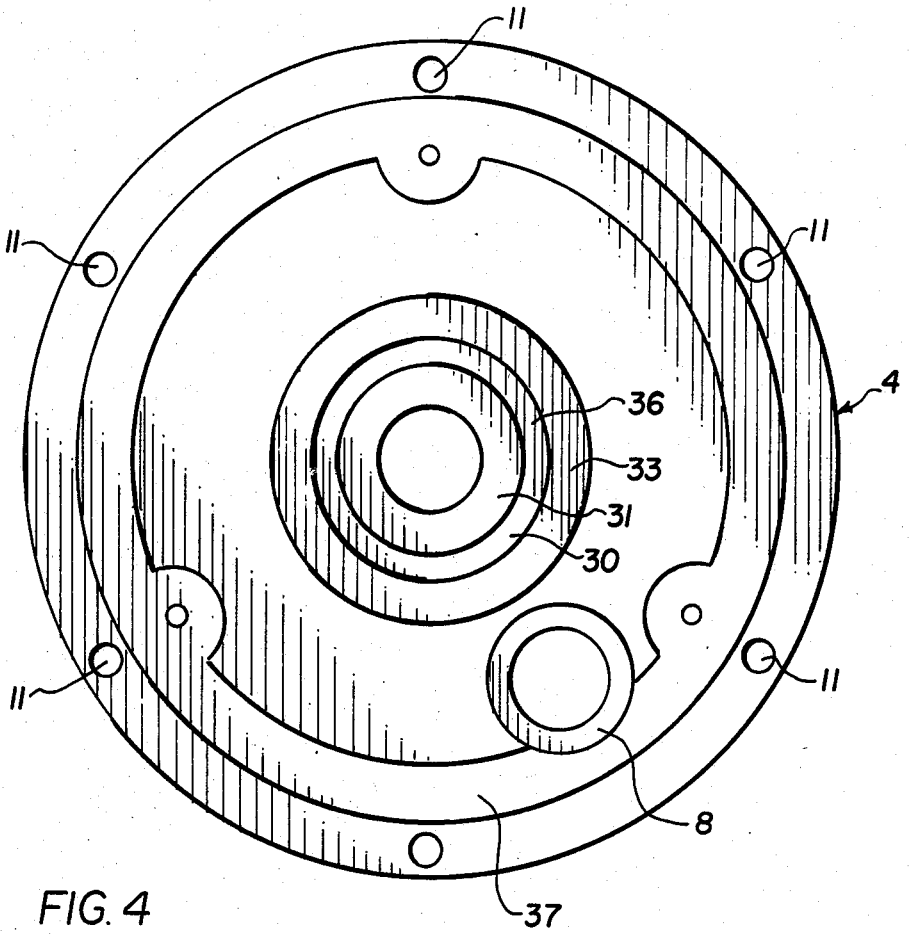
FIG. 4 is a bottom plan view of a preferred embodiment of the device.

Referring to FIG. 4, there is shown a bottom plan view of the device of the present invention. This bottom portion comprises a sealing surface which engages one end of the starter motor. Annular flange 4 having holes 11 is of greater diameter than annular upstanding rim 37. Upstanding rim 37 is adapted to engage one end of the starter motor. Bore 33 receives a double seal and bearing. Preferably, the outer seal 30 is a Hoover NSK 6203V sold by Hoover Universal, Inc. of Ann Arbor, Mich. The interior seal 31 is preferably a National Oil Seal, 481481 sold by Federal-Mogul, Inc. of Southfield, Mich. Aperture 8 for receiving the ground lug from the starter motor is also shown.

Referring now to FIGS. 4 and 5, end cap 7 and securing bolts 35 are shown displaced from chamber 5 and fluid cavity 6. Alternative inlet port 25 and alternative outlet port 28 communicate with fluid cavity 6. The sealing surface of the present invention comprises annular flange 4 and rim 37 which engage the end of the starter motor. Bore 33 receives the double seal and bearing mentioned hereinbefore and the starter motor drive shaft or the extension means adapted thereto is journaled through bore 33 and double seal 30, 31 (FIG. 4).

FIG. 6 is a side elevation of the left side of the device. End cap 7 is secured to chamber 5 by screws or bolts 35. Alternative port 24 described above, extends outwardly from fluid cavity 6 (not shown) and is threaded to receive a conduit which carries fluid transported by the pump assembly to the desired mechanism to receive the fluid. Circular flange 4 and upstanding rim 37 provide the sealing surface for the bottom portion of the device.

Figure 8:
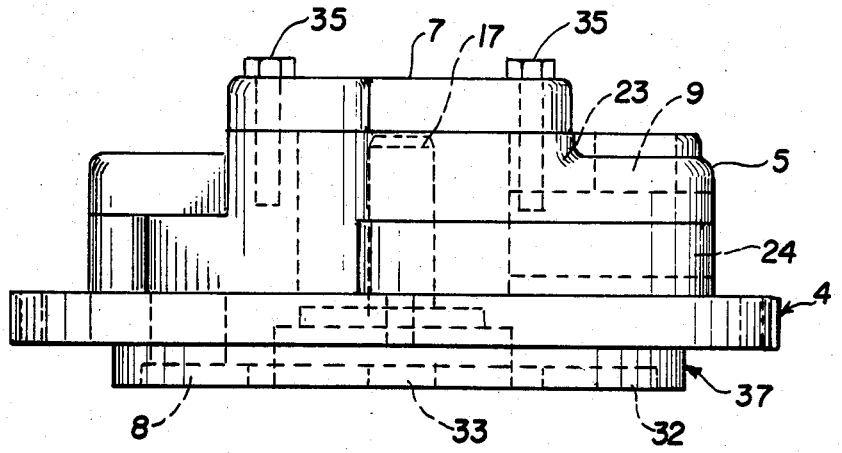
FIG. 8 is a front elevation of a preferred embodiment of the device.

FIG. 8 shows end cap 7 secured to chamber 5 by means of bolts or screws 35. The sealing surface of the device is shown. Aperture 8 is shown in phantom.

Figure 9:
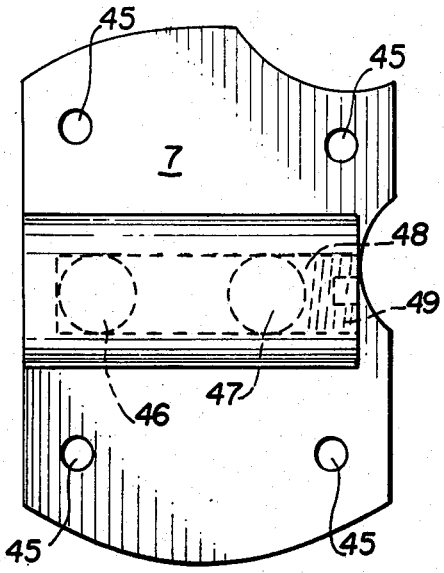
FIG. 9 is a bottom plan view of the end cap of an embodiment of the device with a pressure regulator.
Figure 10:
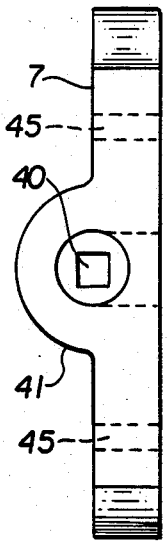
FIG. 10 is a side elevation of the end cap of FIG. 9.

A side elevation of the end cap 7 with pressure regulator 40 in place is shown in FIGS. 9 and 10. End cap 7 is of generally rectangular cross section and has a semicircular extension 41 which receives the pressure regulator device 40. Recesses 46 and 47 are shown in phantom.

Referring to FIGS. 1, 2 and 3, in operation, the device is used as follows: Fluid carried from the fluid delivery system, enters one of the alternative inlet ports 26, 27 or 28. The fluid enters internal passageway 21 and thereafter enters the fluid cavity 6. Therein, driven gear 16 is driven by shaft extension 18, which is more particularly described hereinafter. Following or idler gear 15 operates in mesh with gear 16 and rotates with idler shaft 17. The gears operate to transport the fluid. Fluid exits internal fluid cavity 6 via passageway 22 to the desired outlet port 23, 24 or 25, and is thereafter carried by conduit to the receiver means. Engine oil would be carried to the engine or hydraulic fluid to the hydraulic apparatus to be used.

One embodiment of the device of the present invention includes a pressure regulator which may be more fully understood with reference to the accompanying drawings. Referring to FIGS. 9 and 10, end cap 7 has holes 45 which receive bolts, screws or other suitable securing means for securing end cap 7 to chamber (not shown) of the device. Round recess 48 receives the pressure regulator device 40. Holes 46 and 47 are shown within pressure regulator device 40.

Figure 12:
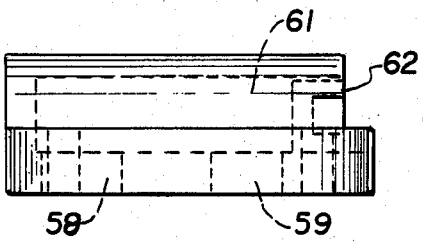
FIG. 12 is a side elevation of the housing of a preferred embodiment of the pressure regulator device.
Figure 13:
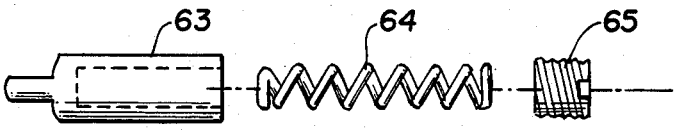
FIG. 13 is an exploded side elevation of a preferred embodiment of the pressure regulator device of the present invention.

Referring to FIGS. 12 and 13, pressure regulator device 40 has round interior cavity 61 and passageways 58 and 59. Cavity 61 receives hollow element 63 which fits into slidable element 62. Element 63 has an axial recess open toward one end and receives spring 64 and threaded nut 65 with a square cavity for a wrench or other suitable tool spring 64 is generally coaxial with element 63. Spring 64 under influence of adjustment screw 65 urges element 63 into the recess 61 a predetermined amount to thereby control the amount of pressure in fluid cavity 6.

Figure 11:
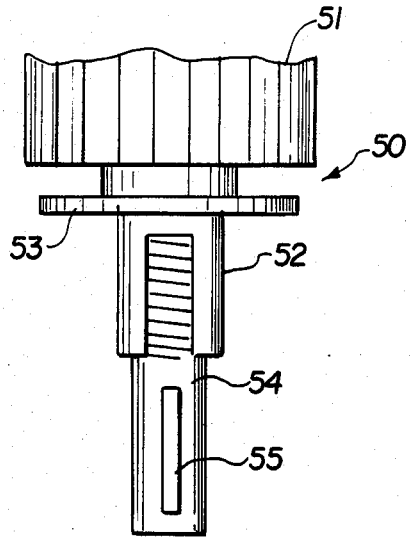
FIG. 11 is a side sectional view of a preferred embodiment of the starter motor shaft extension means of the present invention.

One embodiment of the present invention includes a shaft extension means which is adapted to be secured to the output shaft of the starter motor. This simple improvement allows the device of the present invention to be used with various types of conventional starter motors. It extends through the sealing surface and is operatively associated with the driven gear 16. The extension means turns with the drive shaft and thereby drives the gear means of the device. The extension may be more fully understood with reference to FIG. 11, starter motor 50 has armature 51 and drive shaft 52. Washer 53 and the double seal and bearing (not shown) act to create a seal between the shaft and the pump housing of the present invention. The extension means of the present invention has shaft 54 and aperture 55 which receives, preferably, a ⅛" drive key used to secure the extension means to driven gear 16. In order to use the extension means, original drive shaft 52 must be drilled and tapped to receive threaded extension shaft 54. This simple procedure allows the pump assembly of the present invention to be adaptable to the wide variety of starter motors.

It will be appreciated that the present invention has provided an effective fluid pump assembly which is compact and economical to manufacture and use. The pump assembly of the present invention may be employed in a variety of situations where fluid is required to be delivered in or adjacent to a vehicle. As described herein, the pump assembly may be used as an auxiliary lubrication system for preoiling an engine prior to start up. However, while emphasis has been placed on use of the pump assembly of the present invention in connection with the internal combustion engines, the device may conveniently be employed in other modes in and around vehicles. For example, the device may be used in connection with a hydraulic system used to operate a vehicle snow scraper blade, a log splitter, or the bed of a small dump truck. Moreover, the device is not confined to use in connection with ground vehicles. Rather, the device of the present invention may be employed in connection with airplanes, boats or other mechanisms.

Whereas particular embodiments of the invention have been described above for purposes of illustration it would be evident to those skilled in the art that numerous variations of the details may be made without departing from the invention as defined in the appended claims.

I claim:

1. A pressure regulating device which comprises:

a cap having a recess formed in the underside of said cap, a retainer element operatively associated with the recess in said cap, said retainer element having an axial recess formed therethrough, plug means fitting in slidable engagement with said retainer element, said plug means having an axial recess open toward one end thereof, said plug means also having a protrusion extending outward from the opposite end thereof, biasing means generally coaxial with said plug means which fits in the recess of said means and which urges said plug means into the recess in said retainer element, and nut means which adjustably influences said biasing means to a predetermined amount urging said plug means forward into the recess in said retainer element.

2. The pressure regulating device of claim 1 wherein said biasing means includes a spring.

3. The pressure regulating device of claim 1 wherein said nut means has threads formed in its outer circumference whereby, the tension associated with a predetermined pressure may be set when said nut means is threaded into said retainer means.

4. The pressure regulating device of claim 1 wherein said retainer element is generally rectangular in cross section.

* * * * *